US008215465B2

(12) United States Patent
Iceberg et al.

(10) Patent No.: US 8,215,465 B2
(45) Date of Patent: Jul. 10, 2012

(54) THERMALLY INSULATED SPORTS BAG

(76) Inventors: Marc Iceberg, Orlando, FL (US); Daniel Lotz, Orlando, FL (US)

( * ) Notice: Subject to any disclaimer, the term of this patent is extended or adjusted under 35 U.S.C. 154(b) by 32 days.

(21) Appl. No.: 12/776,146

(22) Filed: May 7, 2010

(65) Prior Publication Data

US 2011/0031081 A1 Feb. 10, 2011

Related U.S. Application Data

(60) Provisional application No. 61/231,148, filed on Aug. 4, 2009.

(51) Int. Cl.
*A45C 13/00* (2006.01)
*A45C 5/14* (2006.01)

(52) U.S. Cl. ..... 190/125; 190/18 A; 206/315.1; 206/315.4

(58) Field of Classification Search ..... 206/315.1, 206/315.4; 190/18 A, 125
See application file for complete search history.

(56) References Cited

U.S. PATENT DOCUMENTS 3,031,121 A * 4/1962 Chase ..... 383/13
3,521,689 A * 7/1970 Woods, Jr. ..... 383/4
4,063,581 A * 12/1977 Williams ..... 206/315.1
4,402,355 A * 9/1983 Wymore et al. ..... 206/315.1
4,545,414 A * 10/1985 Baum ..... 224/580
5,004,091 A * 4/1991 Natho et al. ..... 190/18 R
5,090,526 A * 2/1992 Jacober ..... 190/107
5,219,075 A * 6/1993 White ..... 206/314
5,562,228 A * 10/1996 Ericson ..... 62/457.2
5,660,476 A * 8/1997 DeCoster ..... 383/29
5,921,387 A 7/1999 Arzoomanian
6,067,813 A * 5/2000 Smith ..... 62/371
6,193,034 B1 2/2001 Fournier
6,336,577 B1 * 1/2002 Harris et al. ..... 224/153
6,612,412 B2 * 9/2003 Sanderson et al. ..... 190/18 A
2007/0017835 A1 * 1/2007 Miller, Jr. ..... 206/315.1
2007/0261976 A1 * 11/2007 Anderson ..... 206/315.4

* cited by examiner

*Primary Examiner* — Sue Weaver

(74) *Attorney, Agent, or Firm* — Daniel Law Offices, P.A.; Jason T. Daniel, Esq.

(57) ABSTRACT

The invention relates to a bag for protecting sports equipment, particularly golf clubs, from damage due to temperature variations. The bag can be comprised of several individual panels, each comprising an insulated material, which create an inner volume into which a golf bag can be inserted. When the top panel is sealed, the insulated material can protect the contents of the bag from damage due to temperature variations.

11 Claims, 3 Drawing Sheets

THERMALLY INSULATED SPORTS BAG

CROSS-REFERENCE TO RELATED APPLICATIONS

This application claims the benefit of U.S. Provisional Patent Application No. 61/231,148 filed on Aug. 4, 2009, the contents of which is fully incorporated herein by reference.

BACKGROUND

1. Field of the Invention

The present invention relates generally to a container for protecting sporting equipment, and more particularly to an insulated sports bag for protecting golf clubs from damage caused by extreme temperature variations.

2. Description of the Related Art

Each year golfers spend hundreds of millions of dollars purchasing and maintaining golf equipment. This is particularly true with regard to precision golf clubs which can cost hundreds of dollars each. However, as the game of golf is both a business and recreational activity, it is not uncommon for golf clubs to remain in the trunk of a car for days or even weeks at a time. Moreover, as golf is most commonly played in tropical or warm weather environments, clubs stored in such a manner can be exposed to extreme heat which can cause variations in the shape of the clubs, thereby reducing the efficiency of the club or rendering them useless for play.

Although traditional "golf bags" for protecting against impact and for use during play are known, the present invention provides a thermally insulated environment for safely storing all types of golf equipment and has features and advantages not provided by traditional golf bags.

Accordingly, it is an object of the present invention to provide a lightweight, collapsable thermally insulated sports bag into which a conventional golf bag and clubs can be placed in order to protect against damage caused by temperature variations. It is also an objective of the invention to provide a thermally insulated sports bag which is simple to use, easy to transport and which is economical to manufacture.

SUMMARY OF THE INVENTION

The present invention is directed to a thermally insulated sports bag for protecting sports equipment from damage caused by temperature variations. One embodiment of the present invention can include a bottom panel interposed between a first side panel and a second side panel along a first axis, and a front panel and a back panel along a second axis. Each of the front, back and side panels can be permanently affixed to the bottom panel and extend upward to define an inner volume of the sports bag. The invention can further include a top panel that is permanently affixed to the first side panel and is removably secured to each of the second side panel, the front panel and the back panel via a securing unit.

Another embodiment of the present invention can include an insulated sports bag having a plurality of layered materials including an outer layer having a waterproof portion, a middle layer having an insulated portion, and an inner layer having a padded portion.

Yet another embodiment of the present invention can include a method of manufacturing an insulated sports bag as described above.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Figure 1:
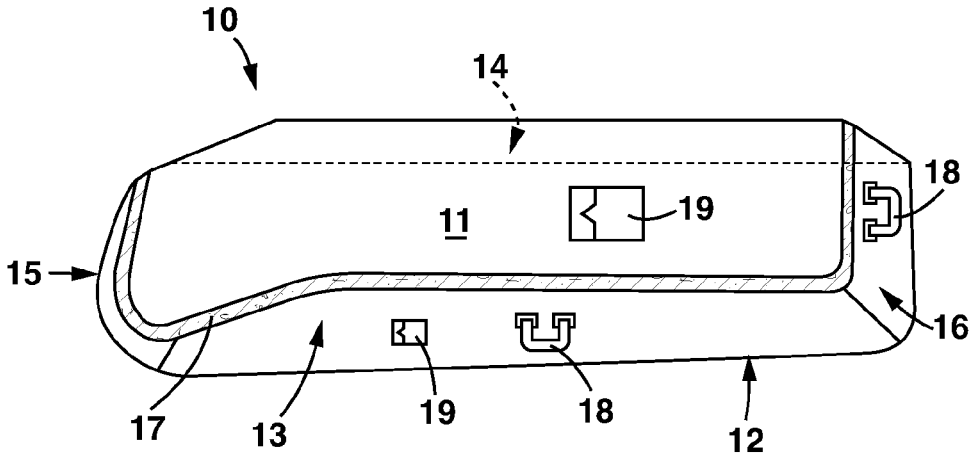
FIG. 1 is a side view of a thermally insulated sports bag that is useful for understanding the embodiments disclosed herein.

FIG. 1 is a side view of a thermally insulated sports bag that is useful for understanding the embodiments disclosed herein. Specifically, FIG. 1 illustrates a collapsible soft sided sports bag 10 that includes top panel 11, bottom panel 12, side panels 13 and 14, front panel 15 and back panel 16. Additionally, sports bag 10 can include one or more optional handles 18 and pockets 19.

In one embodiment, side panels 13 and 14, front panel 15, and back panel 16 can be hinged upwardly from bottom panel 12 via permanent seams. Top panel 11 can be secured to side panel 14 via a similar permanent seam in order to create a rectangular boxlike shape with a cavernous interior. Additionally, side panel 13, front panel 15 and back panel 16 can each be secured to the top panel 11 via an adjustable seal 17 in order to allow access to the cavernous interior (i.e. to open the bag).

As described herein, an adjustable seal 17 can include, for example, a zipper, Velcro®, compression fittings such as snaps and buttons, magnetic elements, or any other known means for creating a reusable seal between two objects. Although described above with respect to specific panels, one of skill in the art will appreciate that the adjustable seal can also be positioned between any two panels in order to allow access to the interior of the bag. Moreover, permanent seams are well known in the art, and can preferably include reinforced stitching to improve strength and to prevent tearing.

Figure 2:
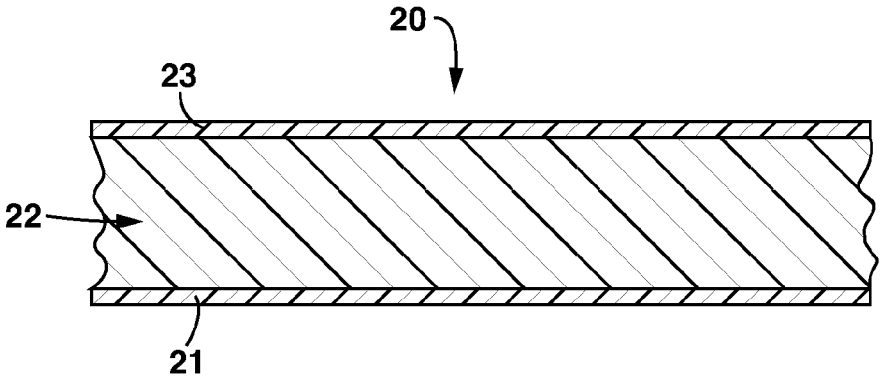
FIG. 2 is a cross sectional view of a material that can be used by the invention.

FIG. 2 is a cross sectional illustration of a material which can be used to create panels 11-16 of the thermally insulated sports bag described in FIG. 1. As shown, material 20 can include one or more individual layers such as a thermal layer 22 interposed between a waterproof outer layer 21 and a plush inner layer 23.

In a preferred embodiment, outer layer 21 can form the outer surface of the bag 10 and can be constructed of a strong waterproof substance such as nylon or other known materials having similar properties and durability. Thermal layer 22 can act as a temperature barrier to isolate the interior of the bag from extreme temperature variations. To this end, thermal layer 22 can be constructed from any number of known insulation materials such as polyurethane or polyethylene foam, for example Inner layer 21 can form the inner surface of the bag 10 and will thus be in direct contact with the bag contents. As such, it is preferable that inner layer 21 be constructed from a soft durable material such as cotton or wool fabric in order to prevent the contents from becoming scratched or damaged, while also providing additional padding to protect against impact.

Although described above with respect to particular materials and three individual layers, one of skill in the art will recognize that any number of layers utilizing several different known materials may also be utilized.

Figure 3:
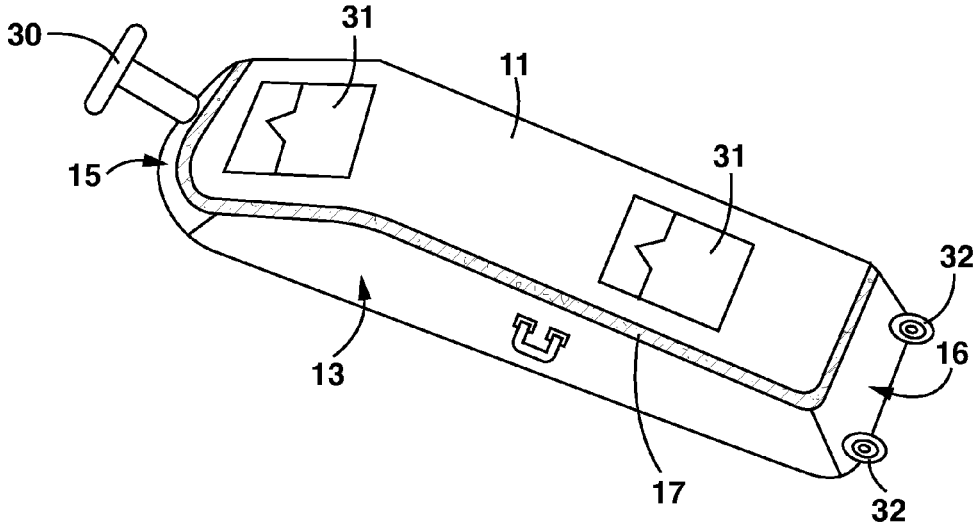
FIG. 3 is a perspective view of an alternate embodiment of the invention.

FIG. 3 illustrates an alternate embodiment of a thermally insulated sports bag 10 for use when traveling. As shown, the sports bag 10 can include a collapsible/retractable handle 30 positioned within front panel 15, one or more large pockets 31 and wheels 32 for easily transporting the bag and its contents. Such an embodiment can be extremely useful when traveling, as many airline and train cargo compartments do not provide temperature regulation. As such, a thermally insulated sports bag as described above can protect against damage resulting from temperature variations in both hot and cold weather environments.

Figure 4:
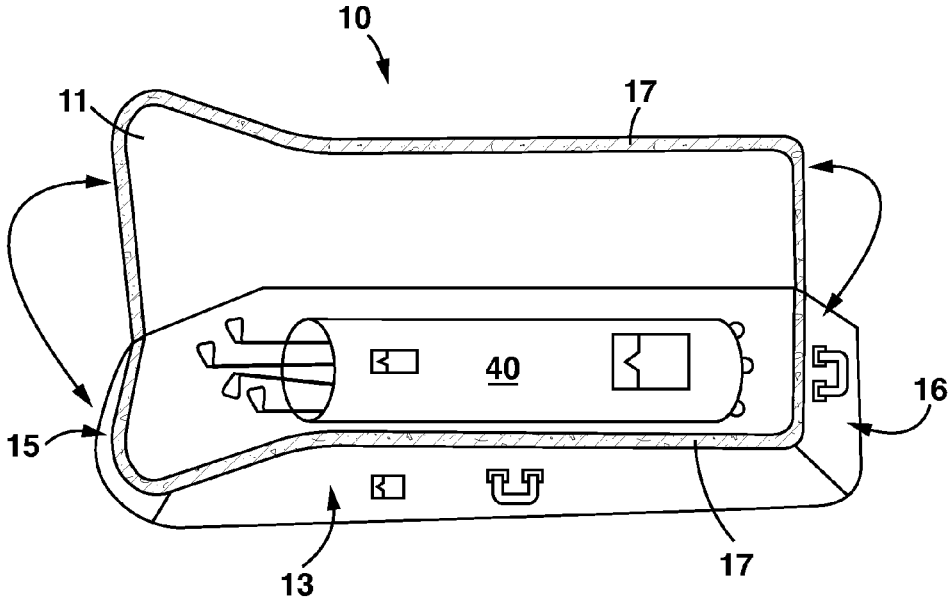
FIG. 4 is perspective view of another embodiment of the invention.
Figure 5:
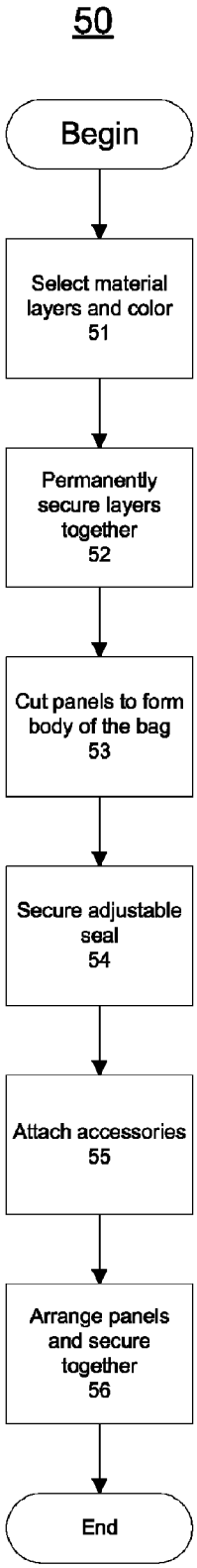
FIG. 5 is a flow chart illustrating a method of manufacturing a thermally insulated sports bag in accordance with the present invention.

In operation, and as illustrated by FIG. 4, contents 40, such as a traditional golf bag and clubs can be inserted into the sports bag 10 when the adjustable seal 17 is in an open position. When the seal 17 is closed, contents 40 can be surrounded by the insulated material comprising the skin of the bag, thus protecting the contents from damage caused from heat and/or extreme cold.

Finally, as the insulated sports bag 10 is designed to easily store golf equipment, one preferred embodiment can include dimensions of approximately 52"×16.5"×14.5," however other size/dimensions are also contemplated. Additionally, owing to the flexible nature of the materials used, the sports bag 10 can be easily folded in order to save space when not in use.

A method of manufacturing a thermally insulated sports bag is now described. Method 50 can begin at step 51 where a suitable material and color selection can be made. To this end, a single material or any number of different materials can be layered to form the skin of the bag as described above.

In step 52, the layers of materials determined in step 51 can be permanently secured together via a strong adhesive, stitching or other known means.

In step 53, the panels used to form the bag (such as panels 11-16 above, for example) can be cut from the finished material of step 52.

In step 54, an adjustable seal can be permanently attached to two or more panels. Such panels will act to form the opening of the bag upon completion of the manufacturing process.

In step 55, any accessories such as fixed handles, retractable handles, pockets and wheels can be attached to the individual panels as needed.

In step 56, the individual panels can be arranged and secured together via permanent seams in order to create the finished sports bag.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A thermally insulated sports bag for protecting sports equipment from damage caused by temperature variations, said bag comprising:

a bottom panel interposed between a first side panel and a second side panel along a first axis, and a front panel and a back panel along a second axis, said first and second axes being perpendicular to each other, each of said front, back, first and second side panels are permanently affixed to the bottom panel along a periphery, and are configured to extend upward to define an inner volume of the sports bag;

a top panel interposed between the first side panel and the second side panel along the first axis, and the front panel and the back panel along the a second axis, said top panel being permanently affixed to the first side panel opposite to the bottom panel, each of said front, back, bottom, top, first and second side panels including an outer layer having a waterproof portion, a middle thermal protection layer configured to isolate the inner volume from temperature variations, and an inner layer having a soft portion configured to prevent items located within the inner volume from becoming scratched; and a securing unit configured to secure the top panel to at least one of the second side panel, the front panel and the back panel to enclose the inner volume of the sports bag.

2. The thermally insulated sports bag of claim 1, wherein each of said layers are permanently secured together to create a single multilayer element.

3. The thermally insulated sports bag of claim 2, wherein when an external temperature is high, said layered materials are configured to maintain a temperature within the inner volume that is lower than said external temperature.

4. The thermally insulated sports bag of claim 2, wherein when an external temperature is low, said layered materials are configured to maintain a temperature within the inner volume that is higher than said external temperature.

5. The thermally insulated sports bag of claim 1, wherein said inner volume is configured to encompass at least one of a golf bag and golf clubs.

6. The thermally insulated sports bag of claim 1, wherein said securing unit includes at least one of a zipper, hook and loop material, compression fitting and magnetic elements.

7. The thermally insulated sports bag of claim 1, wherein said bag is fully collapsible.

8. The thermally insulated sports bag of claim 1, further comprising at least one of a fixed handle, a retractable handle, a pocket and a set of wheels.

9. A thermally insulated sports bag for protecting sports equipment from damage caused by temperature variations, said bag comprising:

a bottom panel interposed between a first side panel and a second side panel along a first axis, and a front panel and a back panel along a second axis, said first and second axes being perpendicular to each other, each of said front, back, first and second side panels are permanently affixed to the bottom panel along a periphery, and are configured to extend upward to define an inner volume of the sports bag;

a top panel interposed between the first side panel and the second side panel along the first axis, and the front panel and the back panel along the a second axis, said top panel being permanently affixed to the first side panel opposite to the bottom panel, each of said front, back, bottom, top, first and second side panels including an outer layer having a waterproof portion, a middle thermal protection layer configured to isolate the inner volume from temperature variations, and an inner layer having a soft portion configured to prevent items located within the inner volume from becoming scratched, and each of said layers being permanently secured together to create a single multilayer element; and a securing unit configured to secure the top panel to at least one of the second side panel, the front panel and the back panel to enclose the inner volume of the sports bag, said bag being fully collapsible.

10. A method of manufacturing a thermally insulated sports bag for protecting sports equipment from damage caused by temperature variations, said method comprising:

selecting a flexible material having a thermal protection layer;

cutting a pattern from said material to form a bottom panel, a first side panel, a second side panel, a front panel, a back panel and a top panel;

affixing the first side panel and the second side panel to the bottom panel along a first axis;

affixing the front panel and the back panel to the bottom panel along a second axis, said first and second axes being perpendicular to each other;

affixing the top panel to the first side panel opposite to the bottom panel; and securing the top panel to each of the second side panel, the front panel and the back panel via a securing unit, wherein said material includes an outer layer having a waterproof portion, a middle layer comprising the thermal layer, and an inner layer having a soft portion, and said method further including binding each of the layers together to form a single element.

11. The method of claim 10, further comprising:

attaching at least one of a fixed handle, a retractable handle, a pocket and a set of wheels to the sports bag.

* * * * *